United States Patent [19]

Wells

[11] 4,347,079

[45] Aug. 31, 1982

[54] METHOD OF OPERATING AN OPEN-HEARTH FURNACE

[75] Inventor: William Wells, Charlotte, N.C.

[73] Assignee: Korf Technologies, Inc., Charlotte, N.C.

[21] Appl. No.: 243,019

[22] Filed: Mar. 12, 1981

[51] Int. Cl.[3] ..... C21C 7/00

[52] U.S. Cl. ..... 75/52; 75/60; 266/214

[58] Field of Search ..... 75/52, 60; 266/214

[56] References Cited

U.S. PATENT DOCUMENTS

| | | | |
|---|---|---|---|
| 3,859,078 | 1/1975 | Haysom | 75/60 |
| 3,861,905 | 1/1975 | Steinmetz | 75/60 |
| 3,945,820 | 3/1976 | Brotzmann | 75/60 |
| 3,999,977 | 12/1976 | Kolb | 75/60 |

*Primary Examiner*—P. D. Rosenberg

*Attorney, Agent, or Firm*—Ralph H. Dougherty

[57] ABSTRACT

Oxygen is blown into an open hearth furnace beneath the surface of the molten metal through a jacketed tuyere, each tuyere angled toward the center of the furnace. A high volume of jacketing coolant is injected through two separate annular passageways around the oxygen to form a large skull around the tuyere. Apparatus is also disclosed for carrying out the process.

7 Claims, 2 Drawing Figures

METHOD OF OPERATING AN OPEN-HEARTH FURNACE

BACKGROUND OF THE INVENTION

This invention relates to a method for producing steel by the open-hearth process, and more particularly to an improved method for operating an open-hearth furnace by introducing oxygen and fuel into the bath, beneath the surface, in a specified orientation and for a determinable period of time. A new sequence of stack damper operation enhances the operation of the furnace.

The utilization of oxygen to assist in refining of steel in an open-hearth furnace has long been known and is described in U.S. Pat. Nos. 2,878,115; 3,115,405; and 3,859,078, among others. Heretofore however the tap-to-tap times still remain approximately 4 hours for 200 ton heats as opposed to about 7 hours for a furnace operated without oxygen.

In the top blown oxygen injection arrangements in the prior art, oxygen lances or tuyeres protruding through the roof burn downward into the metal and damage the bottom lining. Tuyeres which are horizontal and perpendicular to the side walls of the furnace lining as shown in U.S. Pat. No. 3,859,078 create a bottom build-up in the non-active areas, which results in incomplete reaction of the bath components, and leaves molten metal pools in the furnace upon tapping.

I have found that by injecting oxygen into the bath of an open-hearth in the proper location and at the proper angle, I am able to obtain tap-to-tap times on the order of an hour and 45 minutes for 200 ton furnaces.

OBJECTS OF THE INVENTION

It is the principal object of this invention to provide a method for operating an open-hearth furnace which will result in efficiency of operation and substantially increased production.

It is also an object of this invention to provide apparatus for carrying out the method.

DESCRIPTION OF THE DRAWINGS

This invention is better understood by referring to the following detailed description and the attached drawings, in which.

DETAILED DESCRIPTION

Figure 1:
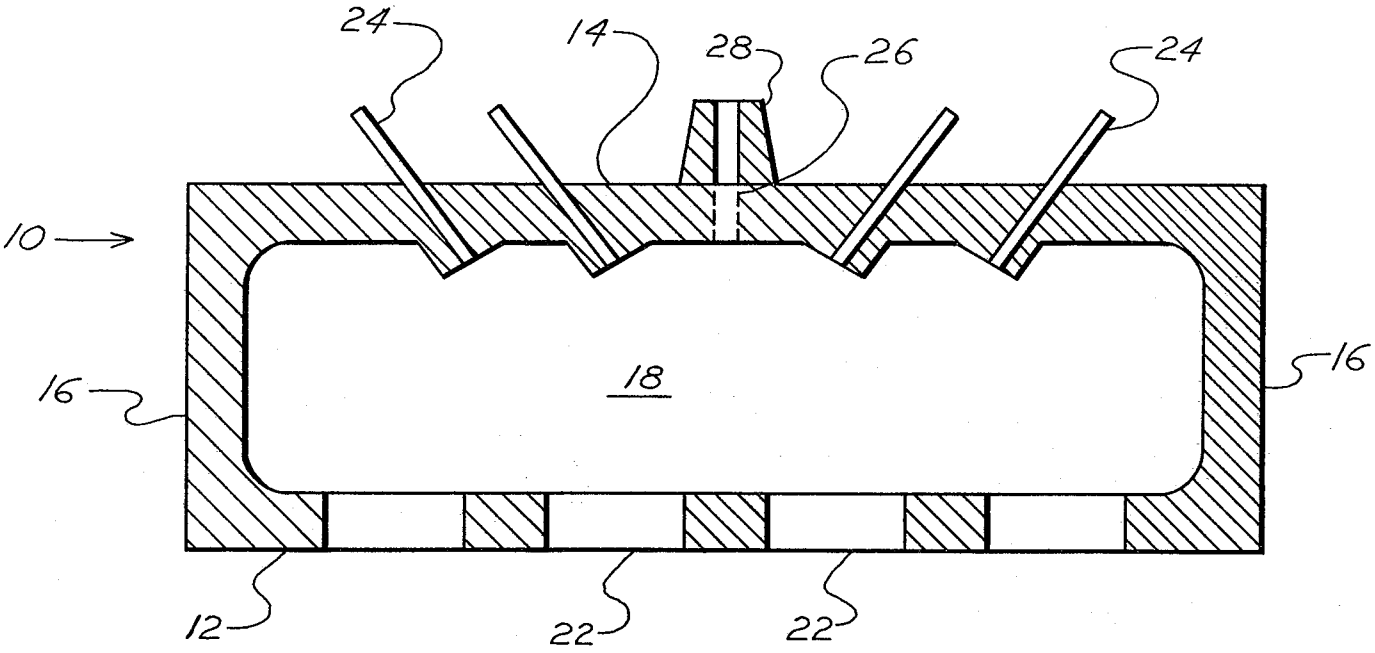
FIG. 1 is a vertical cross-sectioned schematic view of an open-hearth furnace.
Figure 2:
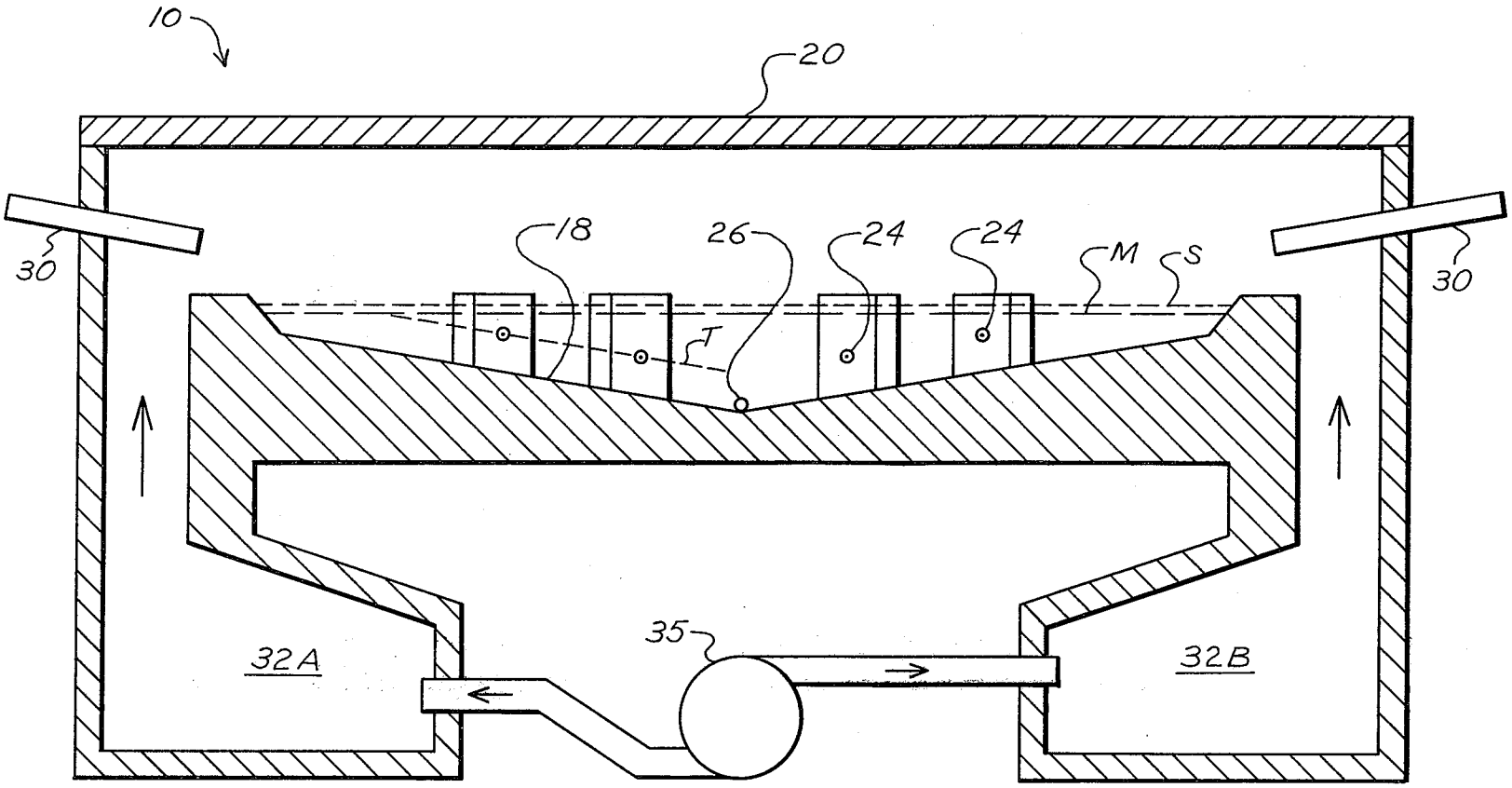
FIG. 2 is a horizontal cross-sectioned schematic view of an open-hearth furnace showing the bottom of the furnace.

As shown in the drawings, a basic open-hearth furnace 10 is defined by front wall 12, back wall 14, end walls 16 and bottom 18. FIG. 2 shows roof 20 and the slope of the furnace bottom 18. All walls are lined with refractory brick, as is the roof. The front wall 12 is provided with charging openings 22. A plurality of tuyeres 24 protrude through the back wall 14 and are inclined with regard to the back wall at an angle indicated as A which varies between 45° and 60°. Angle A will be the same for all tuyeres in a furnace. Taphole 26 leads from the interior of the furnace to tapping spout 28. An equal number of tuyeres is located symmetrically on each side of taphole 26.

The top of the molten bath or slag level is indicated by dotted line S in FIG. 2. The interface between the slag and molten metal is indicated by dotted line M in FIG. 2. All of the tuyeres 24 are located to inject oxygen beneath the slag-metal interface M. Note that when more than one tuyere is positioned on one side of taphole 26, each tuyere is the same height above the bottom lining 18 as each other tuyere. Thus a plurality of tuyeres would be aligned on a line T parallel to the slope of furnace bottom 18.

Each tuyere has 3 concentric gas passages. Oxygen is introduced through the central passage. Alternatively, the oxygen can be mixed with carbon dioxide or air or nitrogen or any combination of these gases. Injected through the second passageway is a cooling gas, such as propane or natural gas, which dissociates endothermically when it contacts the molten metal. Injected through the outer passageway is carbon dioxide or nitrogen or propane or any mixture of two or more of these gases. The outer jacketing gas or mixture is selected according to the current cost of the available gases.

Burners 30 at each end of the furnace provide heat for melting iron and refining the molten bath to steel. Regenerative chambers 32-A and 32-B are connected to the furnace. Hot gases are forced through these chambers by fan 35.

In operation, hot metal along with suitable quantities of iron scrap, slag formers such as limestone, and alloying elements such as ferro-manganese, etc. are placed in the furnace. The stack damper, not shown, is placed in the closed position during charging to prevent draughting of the furnace, unless it is necessary to preheat the charge. The oxygen blow is commenced, the stack damper is opened and combustion air from chamber 32 is introduced to the furnace above the bath to burn carbon monoxide to $CO_2$ and to oxidize the metalloids such as silicon, manganese and carbon, which are then removed into the slag. There is no fuel requirement for the burners above the bath. The only fuel used during the blow is the gaseous jacketing fuel through the oxygen tuyeres 24. The combustion air introduced through the regenerators 32 to the furnace combustion air fan 35, and the bath oxygen introduced through the tuyeres 24 are proportioned so that after oxidizing the metalloids, CO and hydrogen evolving from the tuyeres and exiting the bath are oxidized to carbon dioxide and $H_2O$ within the furnace chamber to provide additional heat.

The stack damper is maintained in a closed position during tapping, fettling, and other delays. No fuel is introduced during any of these times.

In an alternative embodiment, each tuyere may be sloped downwardly at an angle of from 2° to 5° to assist in maintaining the bottom contour of the furnace.

By utilizing the dual jacketing gases around the oxygen tuyeres, a large skull is formed within the bath around the exit end of the tuyere. This material will replace worn refractory around the outer portion of the tuyere without reducing the cooling effect to the central pipes of the tuyere. This results in much less burn back of the tuyere than in normal dual tuyeres, allowing them an operating life up to five times that of a dual tuyere.

The oxygen injected into the bath through the central pipe of the tuyere has as low a velocity as possible and is injected at a pressure of from about 3 to about 4 atmospheres. The oxygen may be mixed with carbon dioxide if desired. The coolant utilized in the jacket surrounding the oxygen pipe is natural gas, propane, liquified petroleum gas or oil, or any of the preceeding mixed with carbon dioxide. Any of the coolants listed may be used as the coolant in the outer jacket. The pressure at which the coolant is delivered through the tuyere is from about 2 to about 3 atmospheres. Thus the pressure of the coolant is about one atmosphere less than the pressure of the oxygen. The quantity of coolant used may be up to about 20% of the volume of oxygen.

It can readily be seen from the foregoing that I have invented a method of operating an open hearth furnace which will increase the efficiency of operation, the rate of production and total output per furnace.

What is claimed is:

1. In a method of operating an open-hearth furnace to produce steel in a molten metal bath therein, said furnace having a front wall with charging openings therein and a back wall with a taphole therein, the improvement comprising introducing at least one stream of oxygen through the furnace back wall lining on each side of the furnace taphole, each oxygen stream being injected horizontally through a tuyere beneath the surface of the molten metal bath and said stream being inclined toward the center of the molten metal bath at an angle between the tuyere and the furnace back wall lining of from about 45° to about 60° to form an active bath area in said furnace in front of said taphole.

2. A method according to claim 1 wherein the bottom of the furnace is sloped from each end to the outlet area near the taphole, an equal number of oxygen streams are introduced to said bath from each side of the taphole, each oxygen stream being the same vertical distance from the furnace bottom as each other stream at the point of introduction of said stream to the bath.

3. A method according to claim 1 wherein said oxygen stream is surrounded by a jacketing gas such as propane or natural gas.

4. A method according to claim 3 wherein the oxygen stream is mixed with carbon dioxide, air, or nitrogen, or any mixture thereof.

5. A method according to claim 3 wherein said oxygen stream and jacketing gas are surrounded by a third gaseous stream selected from the group consisting of carbon dioxide, natural gas, propane or any mixture thereof.

6. A method according to claim 1 wherein said oxygen streams are inclined downwardly to assist in maintaining the contour of the furnace bottom.

7. A method of operating an open hearth furnace to produce steel therein comprising charging suitable quantities of molten iron, ferrous scrap, slag formers and alloying elements to said furnace, maintaining the stack damper in the closed position to prevent draughting of the furnace during charging, introducing oxygen to the furnace beneath the surface of the molten metal bath with the stack damper in the open position and simultaneously introducing combustion air into said furnace above the bath to burn carbon monoxide to carbon dioxide and to oxidize metalloids such as silicon, manganese and carbon to promote their removal into the slag.

* * * * *